US005180348A

United States Patent [19]

Saarinen

[11] Patent Number: 5,180,348

[45] Date of Patent: Jan. 19, 1993

[54] RESISTANCE MECHANISM

[75] Inventor: Sulevi Saarinen, Ilmarinen, Finland

[73] Assignee: Tunturipyora Oy, Finland

[21] Appl. No.: 743,014

[22] Filed: Aug. 9, 1991

[30] Foreign Application Priority Data

Aug. 23, 1990 [FI] Finland ..... 904185

[51] Int. Cl.[5] ..... A63B 21/005; A63B 22/06

[52] U.S. Cl. ..... 482/6; 482/903; 482/63

[58] Field of Search ..... 482/1, 2, 4, 5, 6, 7, 482/61, 903, 900, 901, 63, 57, 92

[56] References Cited

U.S. PATENT DOCUMENTS

| | | | |
|---|---|---|---|
| 4,152,617 | 5/1979 | Janson | 482/903 |
| 4,752,066 | 6/1988 | Housayama | 482/903 |
| 4,826,150 | 5/1989 | Minoura | 482/61 |
| 5,015,926 | 5/1991 | Cosler | 482/903 |

FOREIGN PATENT DOCUMENTS

| | | | |
|---|---|---|---|
| 80214 | 1/1990 | Finland | 482/64 |

*Primary Examiner*—Stephen R. Crow

*Attorney, Agent, or Firm*—Graybeal Jackson Haley & Johnson

[57] ABSTRACT

A resistance mechanism, especially for exercise devices. The resistance mechanism comprises operating structure by which the user loads the resistance mechanism; a part rotating with the movement created by the operating structure; and a counterpart positioned at a distance from the rotating part, one of said parts being provided with magnets to create eddy currents resisting the movement of the operating structure. To achieve a mechanism suitable for exercise devices of different types, the counterpart comprises an element acting on the rotating part, said element being arranged to be rotated at a speed independent of the speed of rotation of the rotating part produced by the operating structure.

7 Claims, 2 Drawing Sheets

RESISTANCE MECHANISM

The invention relates to a resistance mechanism, especially for an exercise device, comprising operating means by means of which the user loads the resistance mechanism; a part rotating with the movement created by the operating means; and a counterpart positioned at a distance from the rotating part, one of said parts being provided with permanent magnets to create eddy currents resisting the movement of the operating means.

Such resistance mechanisms are well-known in the art. One example of resistance mechanisms known in connection with exercise devices is the arrangement disclosed in Finland Patent Specification 80214. In this prior art arrangement the user of the device makes one part of the mechanism rotate while the other part is supported to the frame of the device, so that it remains stationary. The achievement of a sufficient speed difference between these parts has been problematic. If the speed difference is not sufficient, the braking effect of the resistance mechanism remains low. For this reason, the arrangement of Finland Patent Specification 80214 is operable in connection with an exercise cycle, in which the speed difference can be made sufficient by a rather small transmission ratio, whereas a sufficient speed difference cannot be achieved without a complicated construction e.g. in muscle exercising devices in which the movements are performed back and forth and rather slowly. So a resistance mechanism based solely on eddy currents is not particularly suitable for use in a muscle exercising device, for instance.

The object of the invention is to provide a resistance mechanism which avoids the drawbacks of the prior art. This is achieved by means of a resistance mechanism according to the invention, which is characterized in that the counterpart has an element acting on the rotating part, said element being arranged to be rotated at a speed independent of the speed of rotation of the rotating part produced by the operating means.

An advantage of the invention is that it is very suitable for exercise devices of various types. Another advantage is that traditional springs or weights used previously for the return movement are not needed. This is of essential importance in muscle exercise devices in particular. Still another advantage is that the invention is simple and therefore advantageous to utilize.

In the following the invention will be described by means of a preferred embodiment shown in the attached drawings, in which FIG. 1 illustrates the principal features of a resistance mechanism according to the invention;

Figure 1:
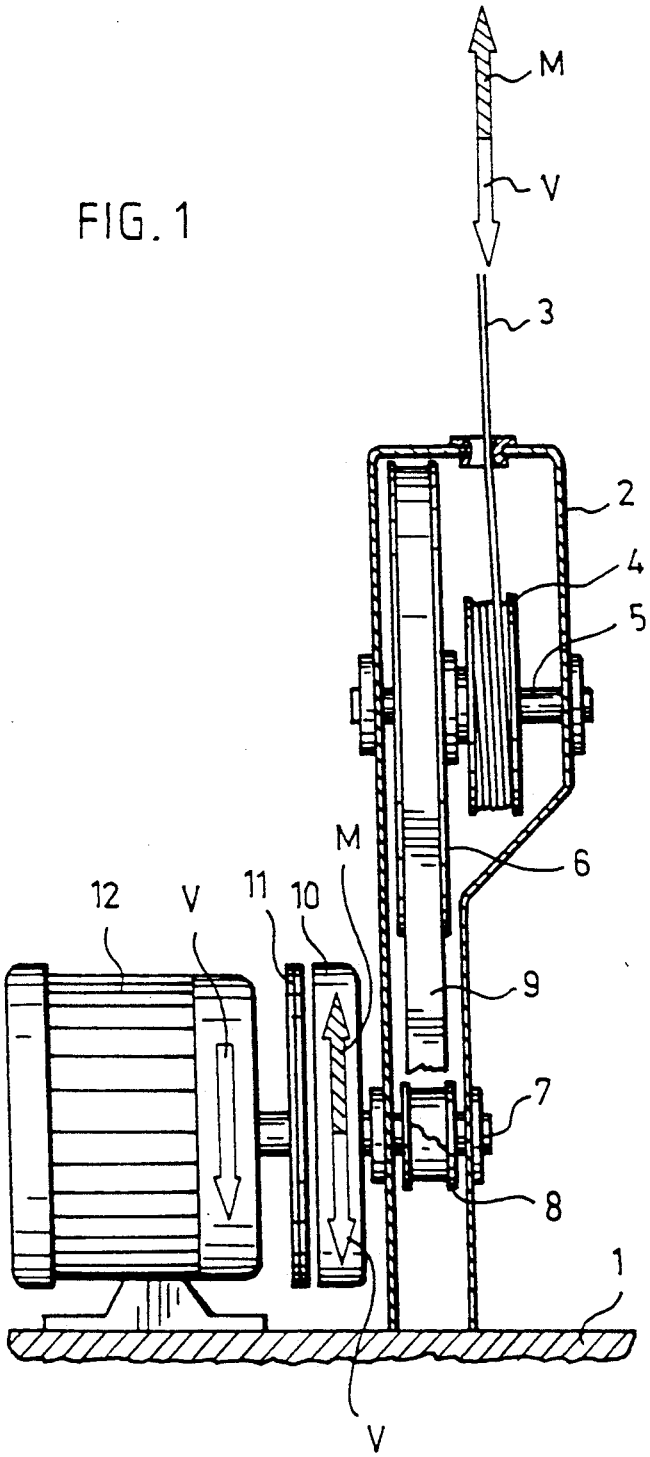

In FIG. 1, the reference numeral 1 indicates an underlying surface on which the mechanism is positioned. The reference numeral 2 indicates an encasing surrounding the mechanism. The reference numeral 3 indicates an operating means by means of which the user loads the resistance mechanism. The operating means 3 may be e.g. the pulling means of the muscle exercise device, such as a pull rope or belt, that is, a member which the user grasps and at which he or she pulls when exercising on the device. The operating means may also be formed e.g. by the pedals of an exercise cycle, as will be described below. In the embodiment shown in FIG. 1, one end of the operating means 3 is provided with a suitable handle which the user can grasp firmly. The handle is not shown in FIG. 1.

The other end of the operating means 3 is attached to the periphery of a rope pulley 4. The rope pulley 4 is attached to a shaft 5. A belt pulley 6 is also attached to the shaft 5. A second shaft 7 is also fitted in the encasing 2, and another belt pulley 8 is attached to it. The belt pulleys 6 and 8 are interconnected by a cogged belt 9. The rope pulley 4 and the shaft 5 form power transmission means by means of which the linear back-and-forth movement of the pulling means used in this particular embodiment is converted into rotary movement. The rotary movement is transmitted by means of the belt pulleys 6 and 8 and the cogged belt 9 to the second shaft 7.

In addition, a part 10 is fitted on the second shaft 7 positioned within the encasing 2 so that it rotates with the rotary movement of said second shaft 7. In the embodiment shown in the figure, the part 10 rotating together with the movement of the pulling means 3 is provided with magnets, such as permanent magnets, to create eddy currents resisting the movement of the pulling means 3. The arrangement of the figure further comprises a counterpart 11 positioned at a distance from the part rotating with the rotary movement of the pulling means 3.

According to the basic idea of the invention, the counterpart 11 has an element acting on the part 10 rotating with the movement of the pulling means 3, and this element is arranged to be rotated at a speed independent of the speed of rotation of the part 10 rotated by the pulling means. This implies that when the counterpart 11 is rotated independently of the speed of rotation of the part 10, a sufficient braking torque will be provided substantially independently of the speed at which the user pulls at the pulling means. In the embodiment of the figure, the element of the counterpart 11 acting on the part 10 is formed by a plate made of a metal material. In this embodiment, the whole counterpart forms the element acting on the part 10. In the embodiment shown in the figure, the counter part 11, that is, the plate is rotated by a separate power source, such as an electric motor 12.

In principle, the embodiment shown in the figure operates in the following way in a muscle exercising device. The user grasps the pulling means 3 and pulls in a direction indicated by the black arrow. As a result, the part 10 provided with the magnets rotates correspondingly in the direction of the black arrow. The black arrows are indicated in the figure by the reference M. As the user pulls at the pulling means in the direction M, the counterpart 11 is rotated by means of the electric motor 12 in a direction shown by the white arrow, so that a torque in the direction shown by the white arrow is created in the part 10 provided with the magnets. This torque is transmitted to the pulling means 3 as shown by the white arrow. The white arrows are indicated in the figure with the reference V. The counterpart 11 is thus rotated by means of the electric motor 12 in the opposite direction as compared with the direction of rotation of the part 10 when pulling at the pulling means 3. A torque resisting the movement of the pulling means is thereby produced in the part 10 by the eddy currents, which torque is transmitted by means of the belt pulleys and the cogged belt so that it forms a force resisting the pulling movement of the pulling means.

In the embodiment of the figure, the magnitude of the resistance force can be adjusted e.g. by varying the speed of rotation of the electric motor or by varying the distance between the counterpart 11 and the part 10.

As already mentioned above, certain exercise devices have previously required e.g. springs for performing the return movement. When using the invention, no such springs or the like are needed. During the return movement, the direction of rotation of the counterpart 11 rotated e.g. by the electric motor 12 is the same as that of the part 10. However, it is to be noted that the speed of rotation of the counterpart 11 achieved by the electric motor is so high as compared with that of the part 10, that there is no essential difference in the torque created in the part 10 and thus the force transmitted to the pulling means as compared with the pulling movement situation described above. During the return movement, it is essential that the counterpart rotated by the electric motor 12 creates a torque in the part 10 on the eddy current principle, which torque in a way draws the pulling means back to the starting position onto the pulley 4.

Figure 2:
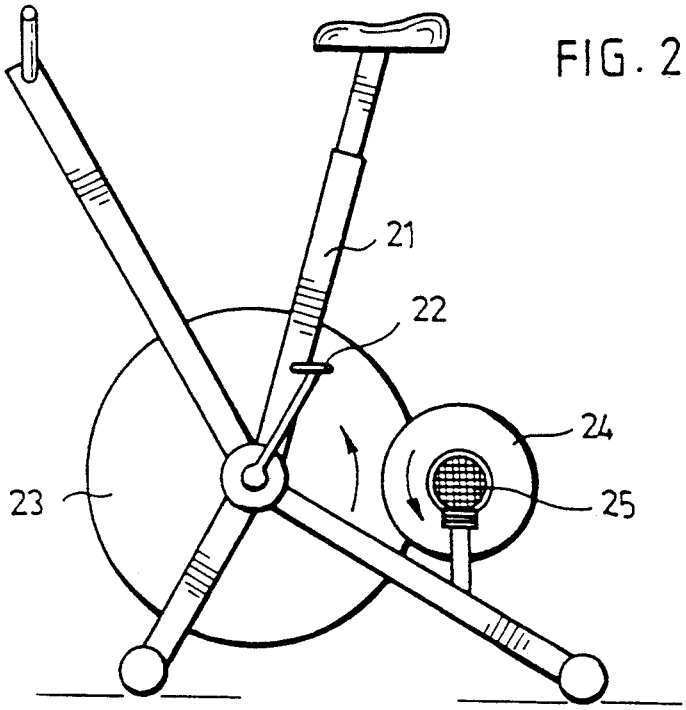
FIG. 2 illustrates the resistance mechanism of the invention when fitted in an exercise cycle.

FIG. 2 shows the resistance mechanism according to the invention when fitted in an exercise cycle. The reference numeral 21 indicates the frame of the exercise cycle. The reference numeral 22 indicates pedals serving as operating means in this embodiment. The reference numeral 23 indicates a flywheel which in this particular embodiment serves as a part moving with the movement of the operating means. The reference numeral 24 indicates a counterpart positioned at a distance from the flywheel 23, and the reference numeral 25 indicates an electric motor arranged to rotate the counterpart 24.

In the embodiment of FIG. 2, the flywheel 23 rotates in a direction shown by the arrow when the pedals 22 are used. The direction of rotation is opposite to the direction of rotation of the electric motor 25. The counterpart 24, in this embodiment a magnet plate, is fitted on a shaft 25 of the electric motor 25. Permanent magnets are attached to the magnet plate 24, and the flywheel is of electrically conductive metal. The magnet plate 24 and the flywheel 23 partly overlap, and the distance between the overlapping surfaces is small. The magnet plate 24 creates eddy currents in the flywheel 23, which eddy currents brake the rotary movement. Since the electric motor 25 rotates the magnet plate 24, the speed difference between the overlapping surfaces will be great. Accordingly, the speed of rotation of the flywheel 23 need not be increased by means of noisy transmissions in order to provide a sufficient speed difference between the magnets and the flywheel.

Figure 3:
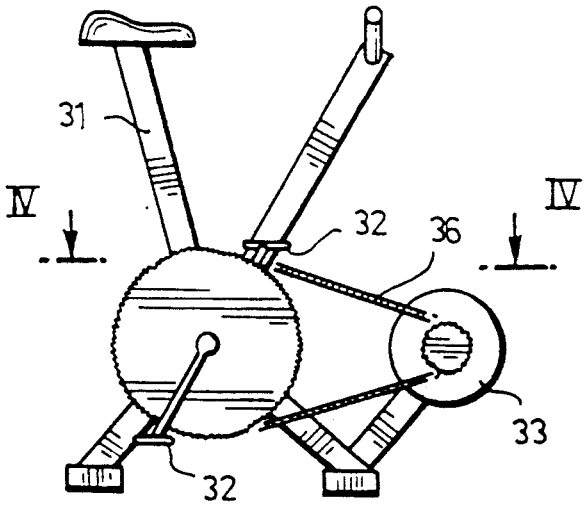
FIG. 3 illustrates the principal features of another exercise cycle arrangement for the resistance mechanism according to the invention in a side view.
Figure 4:
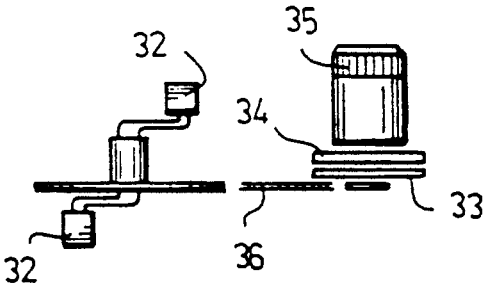
FIG. 4 illustrates the arrangement of FIG. 3 in the direction of the arrows IV—IV.

FIGS. 3 and 4 illustrate another exercise cycle application according to the invention. In FIGS. 3 and 4, the reference numeral 31 indicates the frame of the exercise cycle. The reference numeral 32 indicates pedals which serve as operating means in this embodiment. The reference numeral 33 indicates a part rotating with the movement of the operating means. The reference numeral 34 indicates a counterpart and the reference numeral 35 an electric motor arranged to rotate the counterpart 34. The movement of the operating means, that is, the pedals 32 is transmitted to the rotating part 33 by means of a chain transmission 36.

In this embodiment, the chain transmission 36 rotates the rotating part 33 during pedalling in a direction opposite to the direction of rotation of the counterpart or magnet plate 34 rotated by the electric motor 35. It is, however, to be noted that the counterpart and the magnet plate can change places. A force resisting the pedalling is created as described in connection with the preceding examples.

The embodiment described above is by no means intended to restrict the invention, but the invention can be modified in various ways within the scope of the claims. Accordingly, it is obvious that the mechanism of the invention or its different parts need not necessarily be exactly similar to those shown in the figures, but other solutions are possible as well. For example, the counterpart need not necessarily be a plate such as shown in the figures. It may be formed e.g. in such a way that only a portion of it forms the element acting on the rotating part. Further, it is possible to make the counterpart of electrically conductive material so that current can be applied to the part so that the electric field rotates in the part, that is, the counterpart element acting on the rotating part is a rotating electric field, etc. The resistance torque or resistance forces provided by means of the invention can be adjusted as described above or by using various mechanical transmission ratios so as to achieve suitable resistances for exercise devices of different types. Certain applications require no kind of transmission. The separate power source need not be an electric motor but any other suitable motor can be used.

I claim:

1. Resistance mechanism for an exercise device, comprising operating means by means of which the user loads the resistance mechanism; a first part rotating with the movement created by the operating means and a second part positioned at a distance from the rotating part, one of said first and second parts being provided with permanent magnets to create eddy currents resisting the movement of the operating means and the other of said first and second parts having an element acting on the rotating first part, said element comprising a plate of metal material which is arranged to be rotated by means of a separate power source at a speed independent of the speed of rotation of the rotating first part rotated by the operating means.

2. Resistance mechanism according to claim 1, wherein the separate power source is an electric motor.

3. Resistance mechanism according to claim 1, wherein the part rotating with the operating means is a part provided with permanent magnets and the element of the counterpart acting on the rotating part is a plate of metal material.

4. Resistance mechanism according to claim 3, wherein the separate power source is an electric motor.

5. An exercise mechanism characterized by a relatively slowly moving operating means by means of which the user loads resistance mechanism, said resistance mechanism including a first part rotating by the movement created by the operating means and a second part positioned at a distance from the rotating first part, one of said first and second parts being provided with permanent magnet means to create eddy currents resisting the movement of the operating means and the other of said first and second parts having an element acting on the rotating first part, said element being formed of magnetic material which is arranged to be rotated by means of a separate power source at a speed independent of the speed of rotation of the rotating first part rotated by the operating means.

6. An exercise mechanism according to claim 5, wherein the exercise mechanism is a pull type muscle exercise device.

7. An exercise mechanism according to claim 5, wherein the exercise mechanism is a pedal type exercise cycle.

* * * * *